United States Patent [19]

Miller

[11] 4,353,420

[45] Oct. 12, 1982

[54] WELLHEAD APPARATUS AND METHOD OF RUNNING SAME

[75] Inventor: Henry W. Miller, Houston, Tex.

[73] Assignee: Cameron Iron Works, Inc., Houston, Tex.

[21] Appl. No.: 202,594

[22] Filed: Oct. 31, 1980

[51] Int. Cl.[3] ..... E21B 23/02; E21B 23/06; E21B 33/03

[52] U.S. Cl. ..... 166/382; 166/113; 166/123; 166/182; 166/208; 166/387; 285/142

[58] Field of Search ..... 166/120, 123, 182, 183, 166/208, 348, 360, 113, 250, 255, 315, 382, 387, 381; 285/18, 142

[56] References Cited

U.S. PATENT DOCUMENTS

| | | | |
|---|---|---|---|
| 3,468,559 | 9/1969 | Ahlstone | 166/87 X |
| 3,543,847 | 12/1970 | Haeber | 166/208 X |
| 3,871,449 | 3/1975 | Ahlstone | 166/208 X |
| 3,888,306 | 6/1975 | Wetzel | 166/113 X |
| 3,897,823 | 8/1975 | Ahlstone | 166/120 |
| 3,913,670 | 10/1975 | Ahlstone | 166/182 |
| 3,924,678 | 12/1975 | Ahlstone | 166/120 |
| 3,924,679 | 12/1975 | Jansen, Jr. | 166/182 |
| 3,933,202 | 1/1976 | Ahlstone | 166/208 X |
| 4,069,865 | 1/1978 | Gazda et al. | 166/113 |

*Primary Examiner*—Stephen J. Novosad
*Attorney, Agent, or Firm*—Vinson & Elkins

[57] ABSTRACT

A well apparatus and method of running same, which apparatus includes a hanger body with a downwardly facing external shoulder adapted to land on a wellhead housing landing seat and having an external flow passage therearound for flow of fluids past the landing shoulder and around the exterior of the hanger body; a packer assembly adapted to seal against the interior of the wellhead housing and against a seal surface on the hanger body with an actuating sleeve surrounding a mandrel, which sleeve is adapted to move to set the packing ring and includes means holding the sleeve against inadvertent setting and means holding the packer assembly in set position, together with a running tool which is releasably engaged to the hanger body and to the packer assembly so that on seating of the hanger body, the running tool may be released from the hanger body to move the packer assembly into sealing engagement with the hanger body and with the interior of the wellhead housing. The method includes the steps of securing the casing hanger and packer assembly on the running tool, lowering the running tool on a string to land the hanger on the landing seat, submitting the hanger in landed position, releasing the running tool from the hanger and picking up the running string and circulating to clean the upper portion of the casing hanger and packing assembly and interior of the well housing, lowering the running string to set the packer, closing the blowout preventer rams to pressure the annulus above the packer, test the effectiveness of the packer seal and recovering the running tool if the seal is satisfactory.

15 Claims, 14 Drawing Figures

20
40
16
122
138
146
116
128
258
144
130
98
124
99
14
132
46
56
54
52
50
34
32
36
10
28
44
24
30
12
26
121
148
246
254
248
126
134
136
114
68
48
140
38
142
43
42
150
184

20
40
16
122
138
146
121
116
128
118
130
98
126
99
14
144
258
246
254
248
250
238
114
132
148
136
140
139
56
46
54
52
48
186
90
38
50
34
92
32
36
10
28
142
42
44
43
150
30
24
12
26

122
116
246
118
120
248
102
250
100
98
112
60
110
84
86
70
94
74
58
97
72
90
54
52
32
216
34
50
218
228
220
36
10
12
28
150
128
140
244
134
190
194
210
56
204
208
202
192
186
121
126
124
139
114
70
94
58
206
56
72
90
92
234
214
212
232
200
262
260
222
196
142
44
42
30

WELLHEAD APPARATUS AND METHOD OF RUNNING SAME

BACKGROUND

Prior to the present invention the running of a casing hanger and annulus seal required separate trips, some rotation, external hydraulic lines or special retrieval tool. The A. G. Ahlstone U.S. Pat. No. 3,924,678 discloses the running of a casing hanger and packing or annulus seal in a single trip but uses rotational release of the running tool.

The J. A. Haber U.S. Pat. No. 3,543,847 discloses a casing hanger apparatus which can be run, cemented and then packed and locked without rotation of the string. Various darts are used to allow string pressure or annulus pressure to control operations. The packing is set by weight and pressure. Once set, it requires a special retrieval tool to retrieve the packing and lock dogs.

The A. G. Ahlstone U.S. Pat. No. 3,468,559 discloses a hydraulically actuated casing hanger having a seat protector which is run with the casing hanger. Packing is set by pressure and torque can be used to apply further setting pressure.

Other patents such as U.S. Pat. Nos. 3,871,449, 3,897,823 and 3,903,965 disclose hangers and hanger packers which are released by rotation; U.S. Pat. Nos. 3,924,679 and 3,933,202 disclose running hangers and packing and the packing set and then locked by rotation; and Pat. Nos. 3,913,670, 3,924,678 and 4,067,062 disclose running hangers and packing and setting the packers by weight or hydraulics and releasable by hydraulics.

SUMMARY

The present invention provides an improved casing hanger, packer assembly and housing protector and improved methods for running, setting, testing, locating and retrieving such improved apparatus. The steps include the assembling of the casing hanger, packer assembly and housing protector on the running tool having a position locator connected thereto, lowering the running tool with such apparatus supported thereon on a running string to a position seating the hanger on the wellhead landing seat, pressurizing the running string to indicate seating of the hanger, flowing cement through the running tool and into the casing, dropping a shifting tool and pressuring the running string to a preselected level to release the casing hanger from the running tool, lifting the running string a short distance, increasing the pressure in the running string to above said preselected level, opening flow through the shifting tool to wash out above the hanger, lowering the drill string to set and lock the packer assembly, testing the annulus packing, retrieving the tool and running string if the packing holds pressure or retrieving the annulus packing if it does not hold pressure. The apparatus includes a hanger having an upper rim with an inner sealing surface and flow passages communicating between the annulus above and below the hanger seat, a packer assembly, means for separately and releasably securing the hanger and the packer assembly to a running tool, a remote position locator on the running tool, the packer assembly including a mandrel adapted to seal on the hanger rim sealing surface, an annular packing ring, means for protecting the packing ring during running, means for setting the packing ring, means for releasing the set packing ring, and means for engaging the set packing assembly for retrieval.

An object of the present invention is to provide an improved casing hanger-packer apparatus allowing unrestricted flow for cementing after the hanger is seated and thereafter the packer to be lowered and set.

Another object is to provide an improved casing hanger-packer apparatus in which the set packer can be unset and retrieved with the running tool.

Another object is to provide an improved method of running a casing hanger which assures that the hanger is seated before cementing.

Still another object is to provide an improved method of setting a casing hanger-packer apparatus allowing quick retrieval of the packer apparatus after cementing if it does not seal.

A still further object is to provide an improved casing hanger-packer apparatus in which the sealing element is held in a protected position until set.

DESCRIPTION OF THE PREFERRED EMBODIMENT

Figure 1:
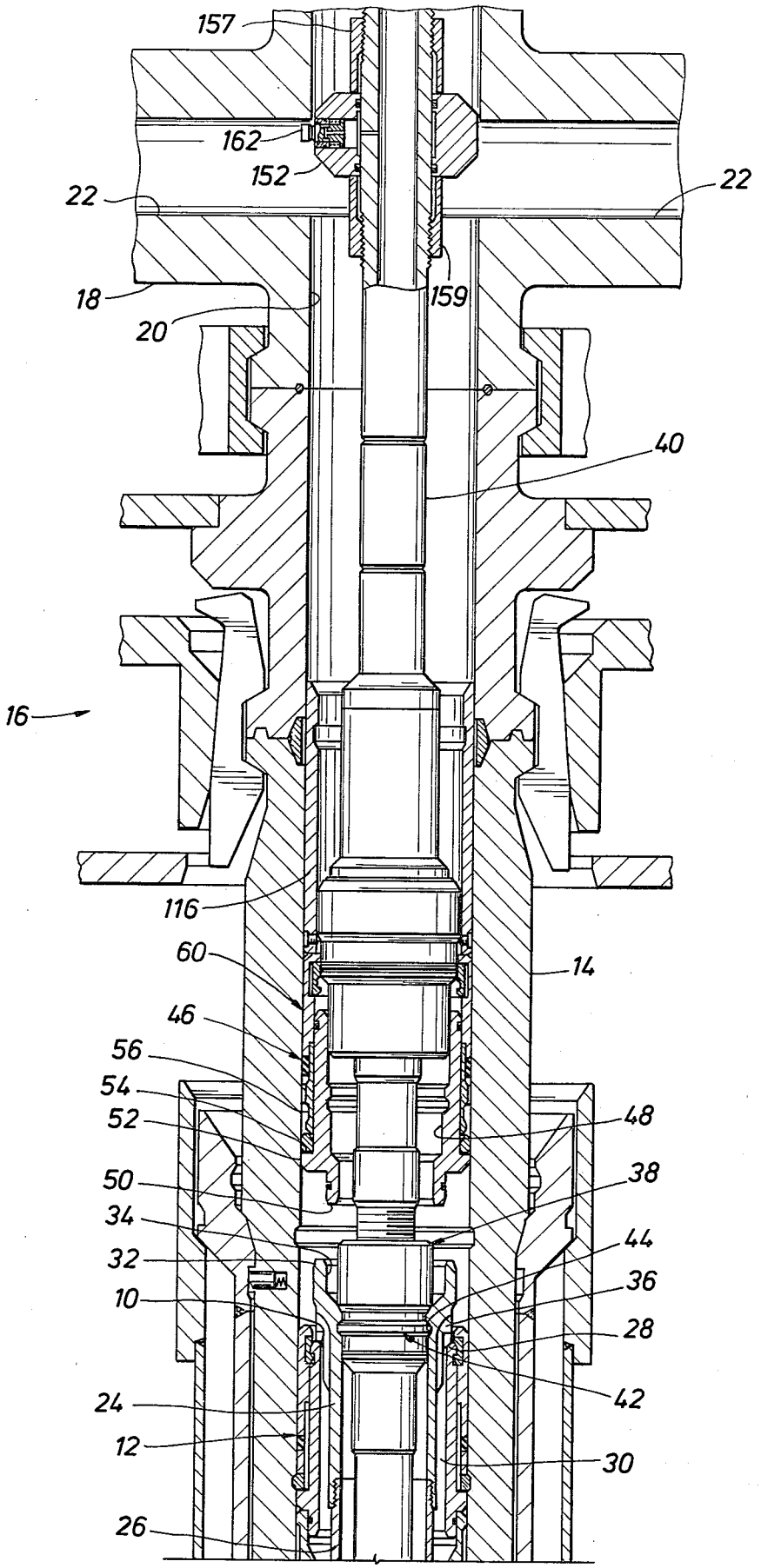
FIG. 1 is a view partly in section showing the improved hanger apparatus landed on the landing seat of a wellhead housing and showing the running tool in elevation and the hanger position locator in extended position.

The improved casing hanger apparatus of the present invention is adapted to be seated on the landing seat 10 of the previously set hanger assembly 12 which is positioned within wellhead housing 14. Remote controlled connector 16 is positioned on the upper end of housing 14 and blowout preventer 18 is connected above connector 16. Housing 14, connector 16 and blowout preventer 18 include central bore 20 through which the improved casing hanger apparatus of the present invention is to be lowered. Guideways 22 of blowout preventer 18 intersect bore 20 as shown in FIG. 1.

Casing hanger 24 has casing 26 threadedly connected to its lower end and has external downwardly facing landing surface 28 which engages landing seat 10. Hanger 24 has a tubular body 30 with an upper larger diameter rim 32 having internal sealing surface 34 and passages 36 between surface 28 and body 30 to allow return flow through the annulus around casing 26 during cementing. Hanger 24 is run into position on running tool 38 which is supported on running string 40. Hanger 24 is releasably connected to tool 38 by latch means 42, such as split latch ring 43 which engages within groove 44 on the interior of hanger 24 as hereinafter described.

Packer assembly 46 is also releasably supported on running tool 38 for running into housing 14 with casing hanger 24. As best seen in FIGS. 10 to 13, Packer assembly 46 includes tubular mandrel 48 which has depending skirt 50, flange 52 extending outward to provide upwardly facing shoulder 54, sleeve 56 releasably secured to the exterior of mandrel 48, packing ring 58 and means 60 for moving packing ring 58 with respect to sleeve 56. Skirt 50 includes groove 62 on its exterior surface 64 with O-ring 66 therein. Skirt 50 is small enough to slide into rim 32 on body 30 and O-ring 66 then seals between surface 34 and surface 64.

Figure 4:
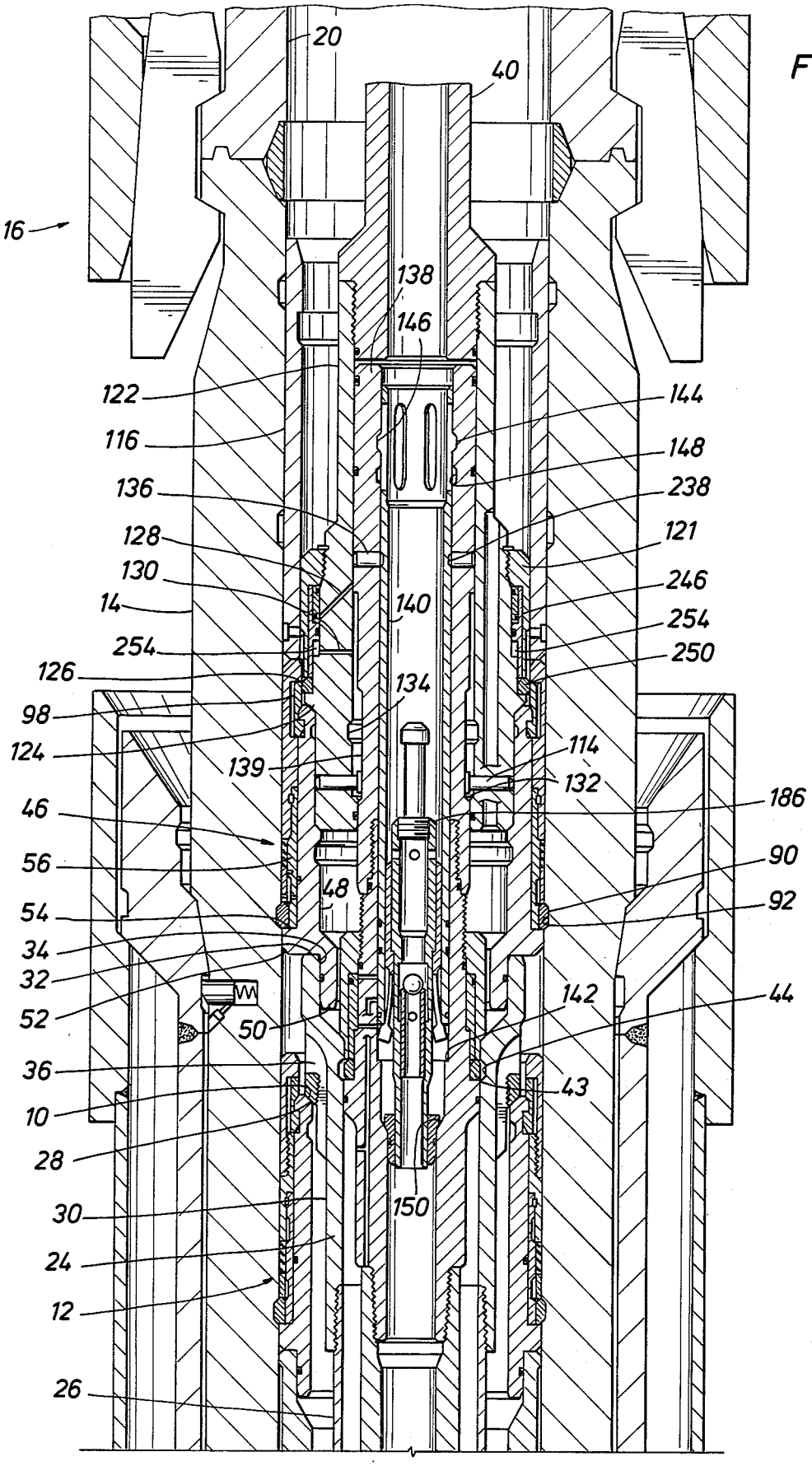
FIG. 4 is another sectional view showing the packer assembly in set position and the running tool ready for removal.
Figure 9:
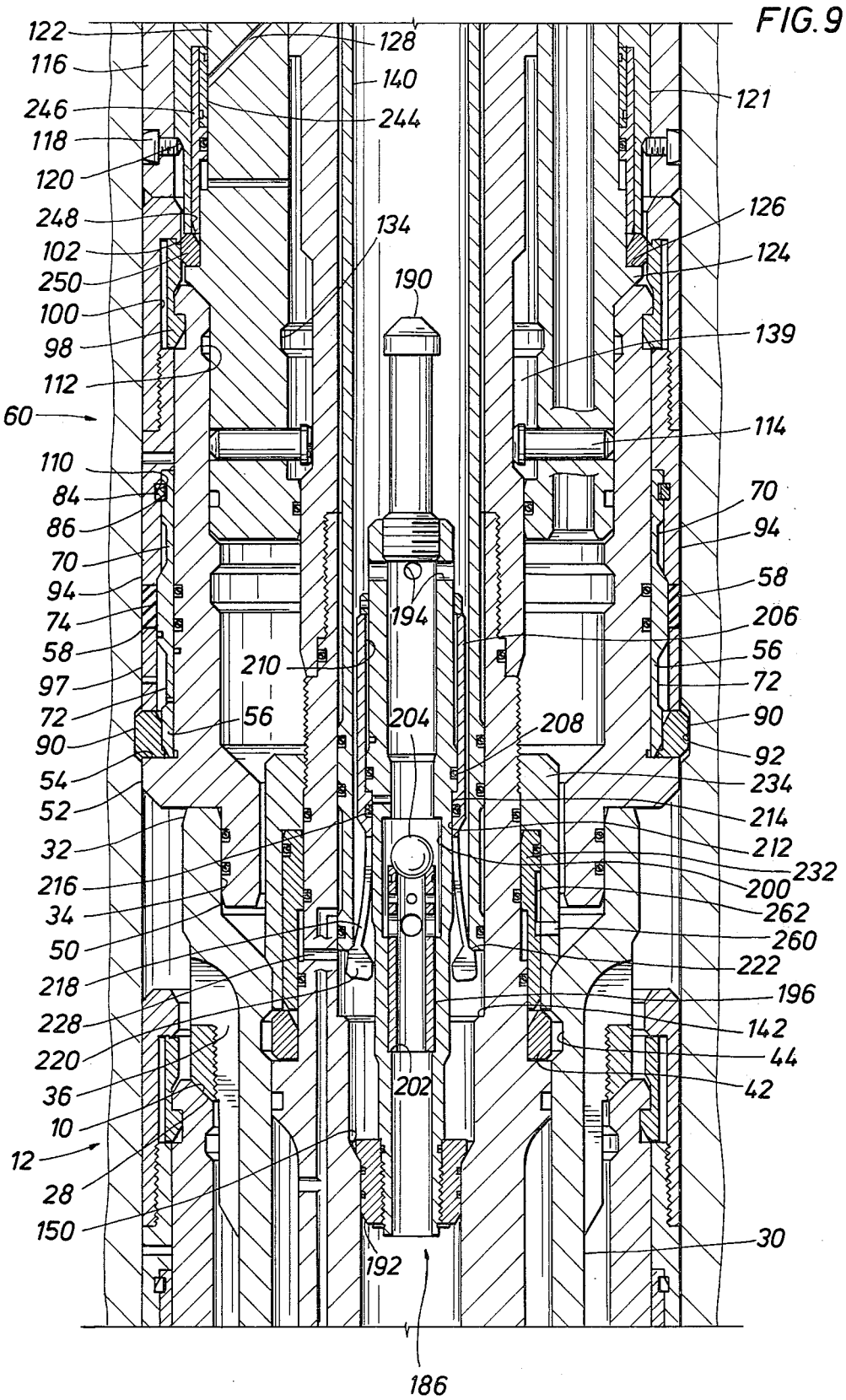
FIG. 9 is another view of the shifting tool with the inner sleeve down as shown in FIG. 4 to establish flow through the shifting tool.
Figure 10:
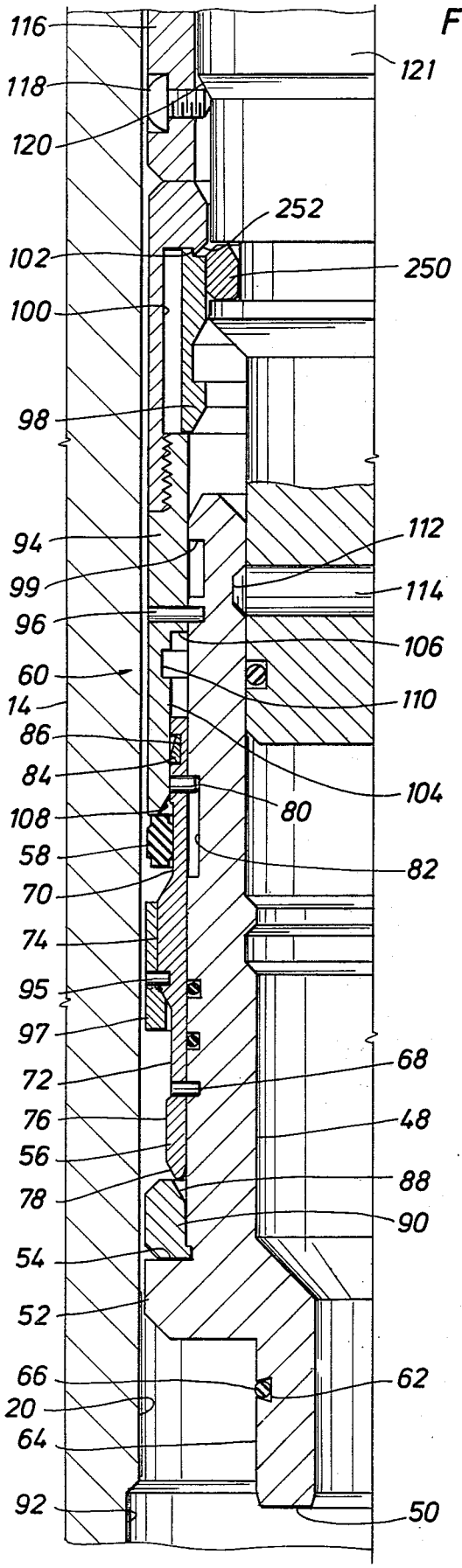
FIG. 10 is a partial sectional view of the packer assembly in running position illustrating the protected position of the packing or sealing ring.
Figure 11:
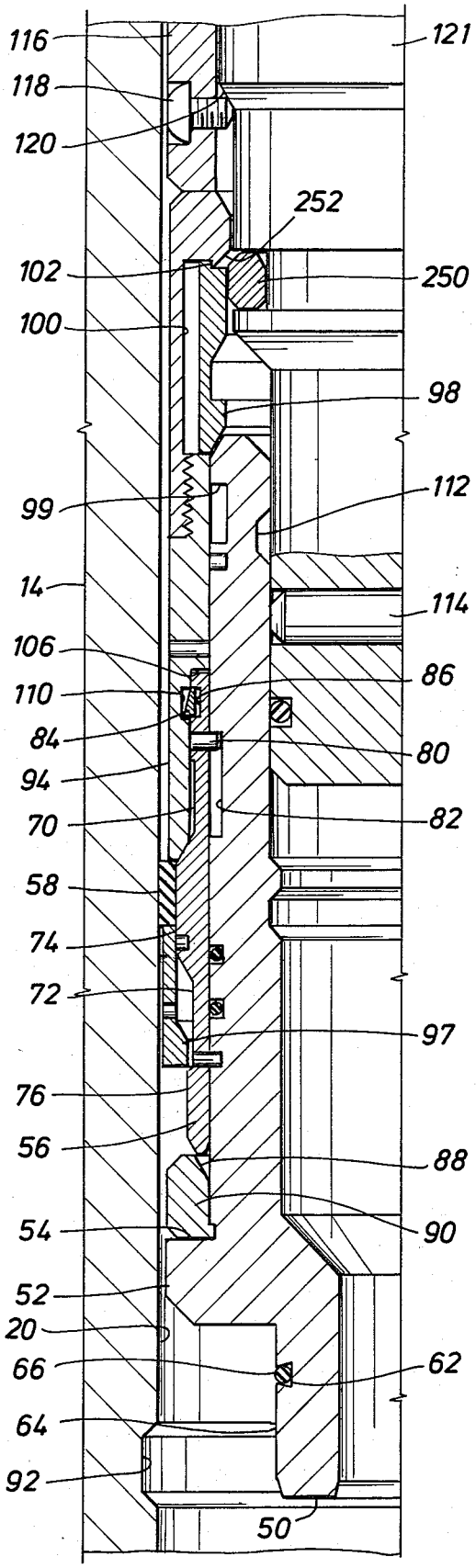
FIG. 11 is a view similar to FIG. 10 but illustrating the sealed position of the packer assembly.
Figure 12:
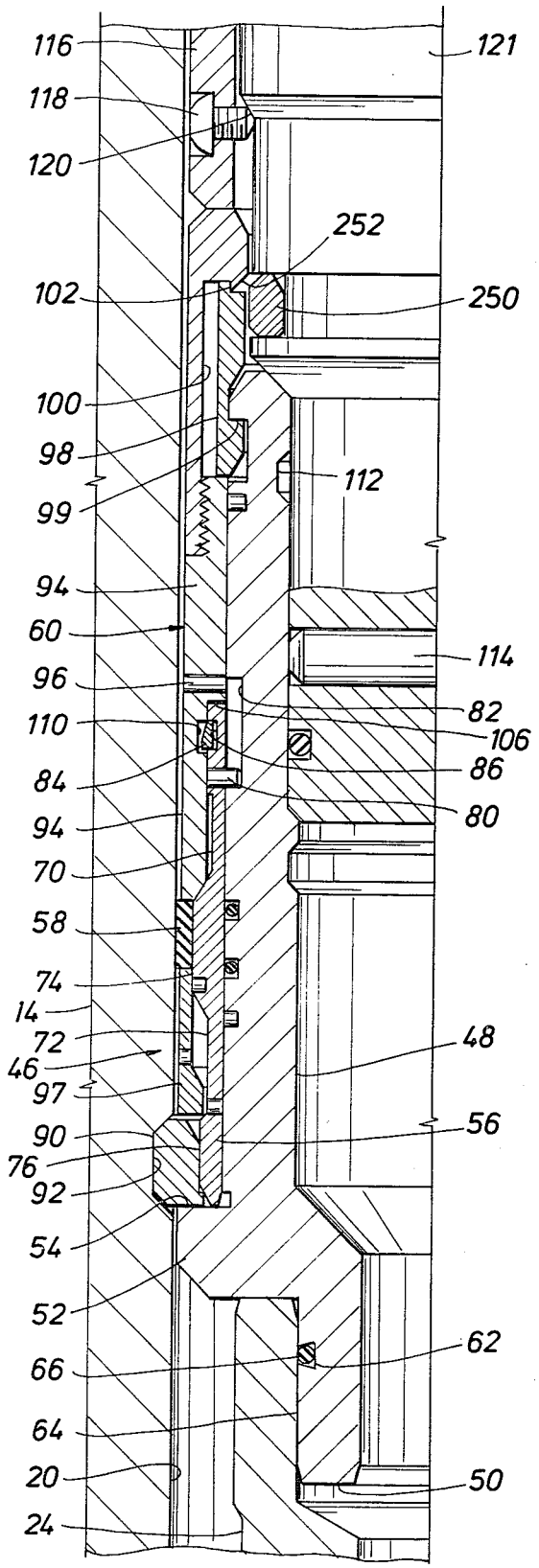
FIG. 12 is another view similar to FIG. 10 but illustrating the locked position of the packer assembly.

As best seen in FIGS. 10 through 13, sleeve 56 is secured to mandrel 48 by shear pin 68 and includes upper groove 70 and lower groove 72 with land 74 therebetween and land 76 on the lower end having external tapered surface 78. Pin 80 extends through sleeve 56 into slot 82 in the exterior of mandrel 48. Also, split locking ring 84 is positioned within groove 86 in sleeve 56 during running. When sleeve 56 moves downward, surface 78 engages tapered surface 88 on locking ring 90 to move ring 90 outward into groove 92 in housing 14 as shown in FIGS. 4, 9 and 12. Moving means 60 includes actuating sleeve 94 surrounds the upper ends of mandrel 48 and sleeve 56 and is releasably connected to mandrel 48 by shear pin 96. Lower ring 97 is secured to sleeve 56 around land 74 by shear pin 95. Upper locking ring 98 is held in internal groove 100 in actuating sleeve 94 by lip 102 on sleeve 94. Sleeve 94 includes internal enlarged bore 104 having shoulder 106 at its upper end, tapered shoulder 108 at its lower end and groove 110 a short distance below shoulder 106. Groove 112 on the interior of mandrel 48 receives pins 114 to support packer assembly 46 on running tool 38 during running. Housing protector 116 is supported on the upper end of sleeve 94 and screw 118 engages shoulder 120 on collar 121 which is secured to running tool 38 as hereinafter described.

Figure 2:
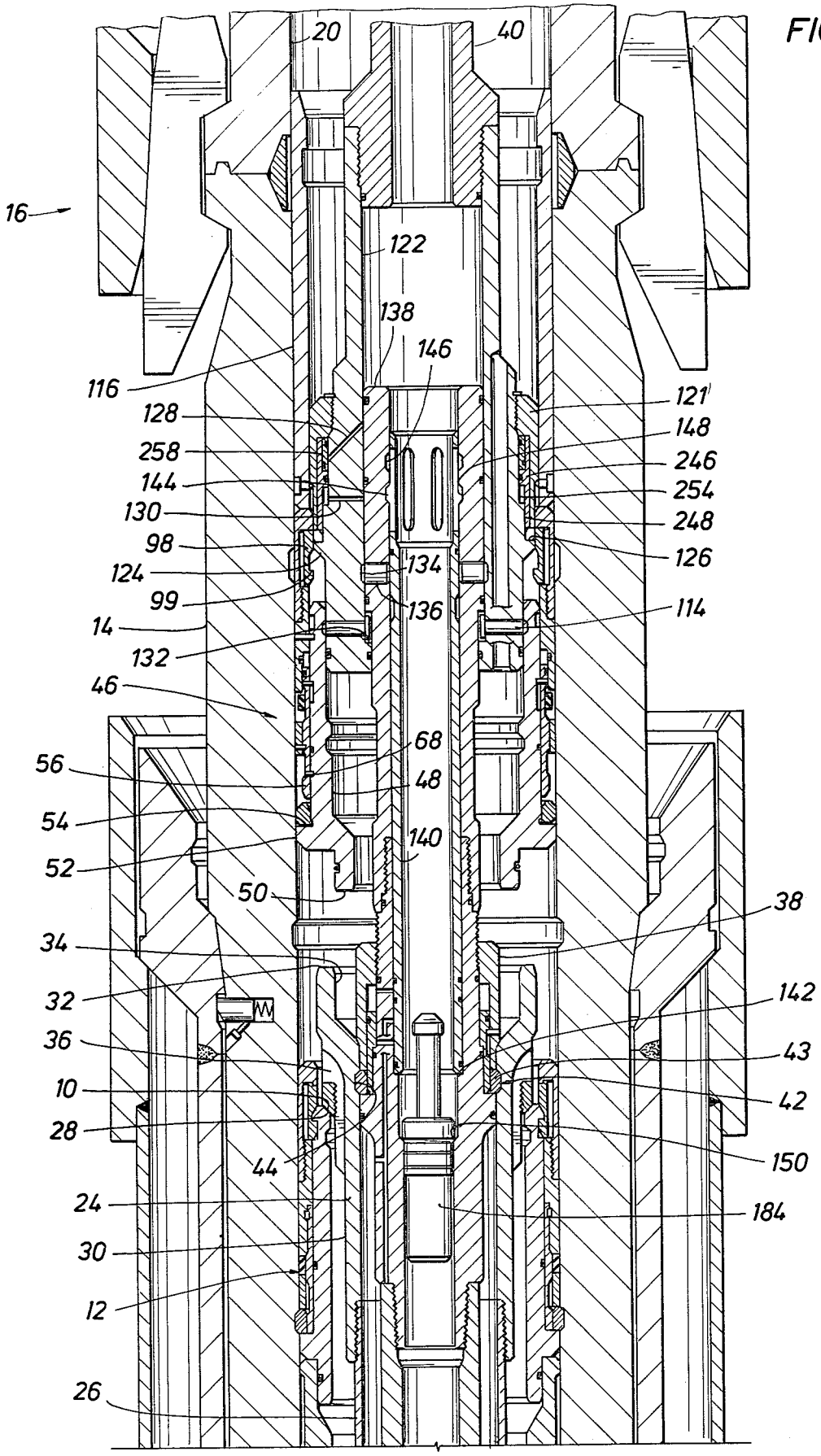
FIG. 2 is similar to FIG. 1 showing the running tool in section.

Running tool 38 includes tubular member 122 (see FIG. 2) which is threaded onto the lower end of running string 40. Member 122 includes external projection 124 with upward facing shoulder 126, ports 128 and 130 extending through member 122 to positions above shoulder 126 on the exterior of member 122. Shoulder 132 on the interior of member 122 faces upward and is immediately below the heads on pins 114 and groove 134 receives pins 136 to connect hanger support 138 to member 122. As shown in FIG. 2, running tool 38 is run with control sleeve 140 positioned on the interior of hanger support 138 and resting on internal shoulder 142 in support 138 and with external projections 144 in the lower of grooves 146 and 148 on the interior of hanger support 138. Seat 150 is in the lower interior of support 138 below shoulder 142.

Figure 1A:
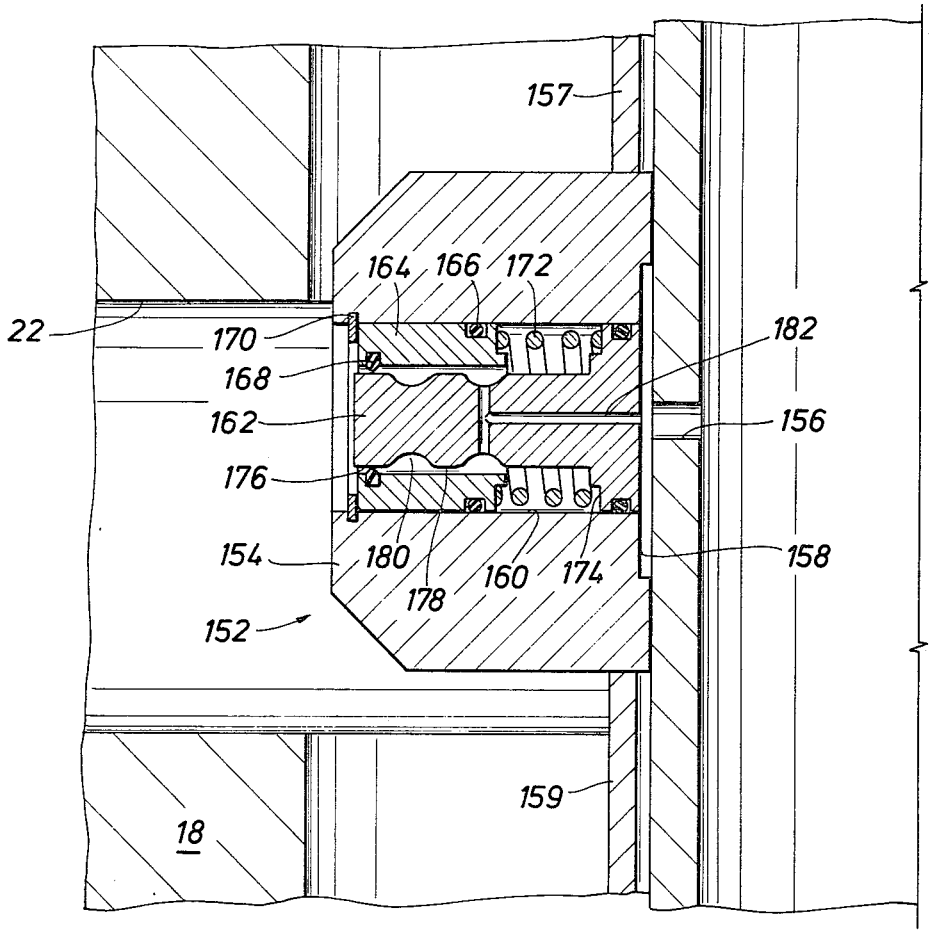
FIG. 1A is a detail sectional view of the locator in retracted or running position.

As shown in FIGS. 1 and 1A, locator 152 is positioned on running string 40 a preselected distance above hanger 24 so that when hanger 24 is on landing seat 10, locator 152 is within blowout preventer 18. Locator 152 includes ring 154 which is positioned in surrounding relation to string 40 at an adjustable position to assure that port 156 through string 40 is in communication with annular chamber 158 around the interior of ring 154. Collars 157 and 159 are threaded onto the exterior of string 40 to position locator 152 the distance above landing surface 28 which guideways 22 are above landing seat 10. Cylinder 160 extends radially through ring 154 and piston 162 is positioned therein for radial movement. As best shown in FIG. 1A, seal ring 164 is retained in the outer portion of cylinder 160 and includes O-ring 166 sealing against the interior of cylinder 160 and internal annular seal 168 adapted as hereinafter set forth to seal against the exterior of piston 162. Snap ring 170 retains seal ring 164 in position and spring 172 urges seal ring 164 outward and engages flange 174 on piston 162 to urge piston 162 inward. Piston 162 includes outer sealing surface 176, inner sealing surface 178 separated by groove 180. Groove 180 has sufficient depth to assure that annular seal 168 does not seal around piston 162 when groove 180 is aligned with annular seal 168. Piston 162 is sized so that when piston 162 is aligned with guideway 22, piston 162 is positioned with groove 180 aligned with seal 168 thus allowing flow of fluid through passage 182 and groove 180 past seal 168 but when piston 162 is within guideways 22 of blowout preventer 18 and pressure exerted in string 40 is transmitted through port 156 into chamber 158 urges piston 162 outwardly. Piston 162 then is positioned with seal 168 engaging sealing surface 178 to prevent flow of fluid past seal 168. Thus, if pressure is maintained in string 40, piston 162 is within guideways 22 and this indicates that hanger 24 is seated in landing seat 10.

The improved apparatus of the present invention is shown in FIG. 1 as run but in the landed position and further showing the locator 152 detecting the landed position by the extension of its piston 162 into guideways 22 of blowout preventer 18. This is accomplished by dropping dart 184 (shown in FIG. 2) and pressuring string 40 after dart 184 engages seat 150. This causes pressure to be exerted on piston 162 to urge it toward its extended position and if it is within guideways 22, the pressure in string 40 is sealed and will not drop. Reading the constant string pressure assures sealing of hanger 24 on seat 10. Whenever such pressure reading drops, piston 162 is not in its full extended position, is not aligned with guideways 22 and thus, hanger 24 is not seated on seat 10.

Figure 3:
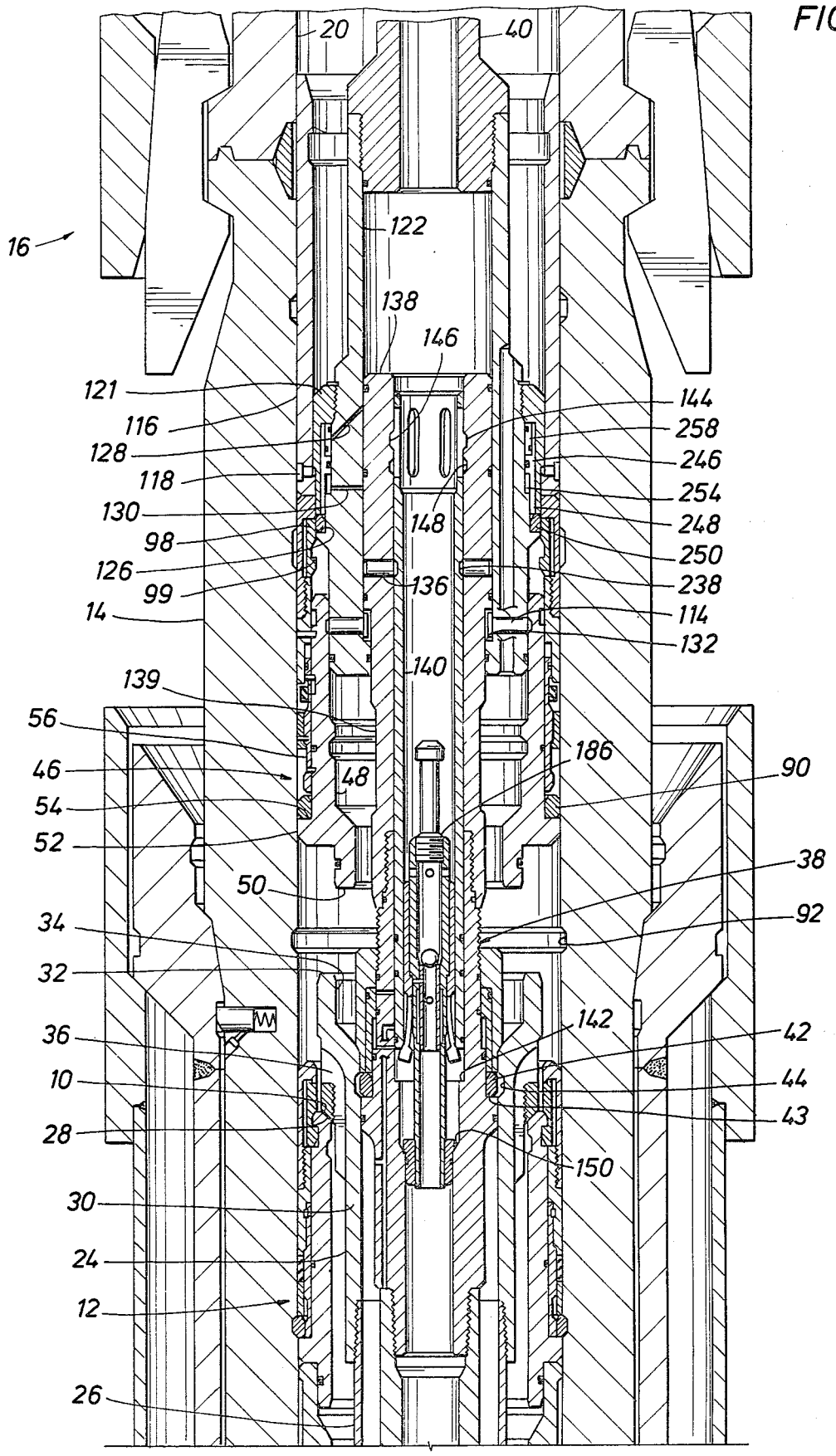
FIG. 3 is another sectional view showing the shifting tool releasing the connection of the running tool to the hanger body.
Figure 7:
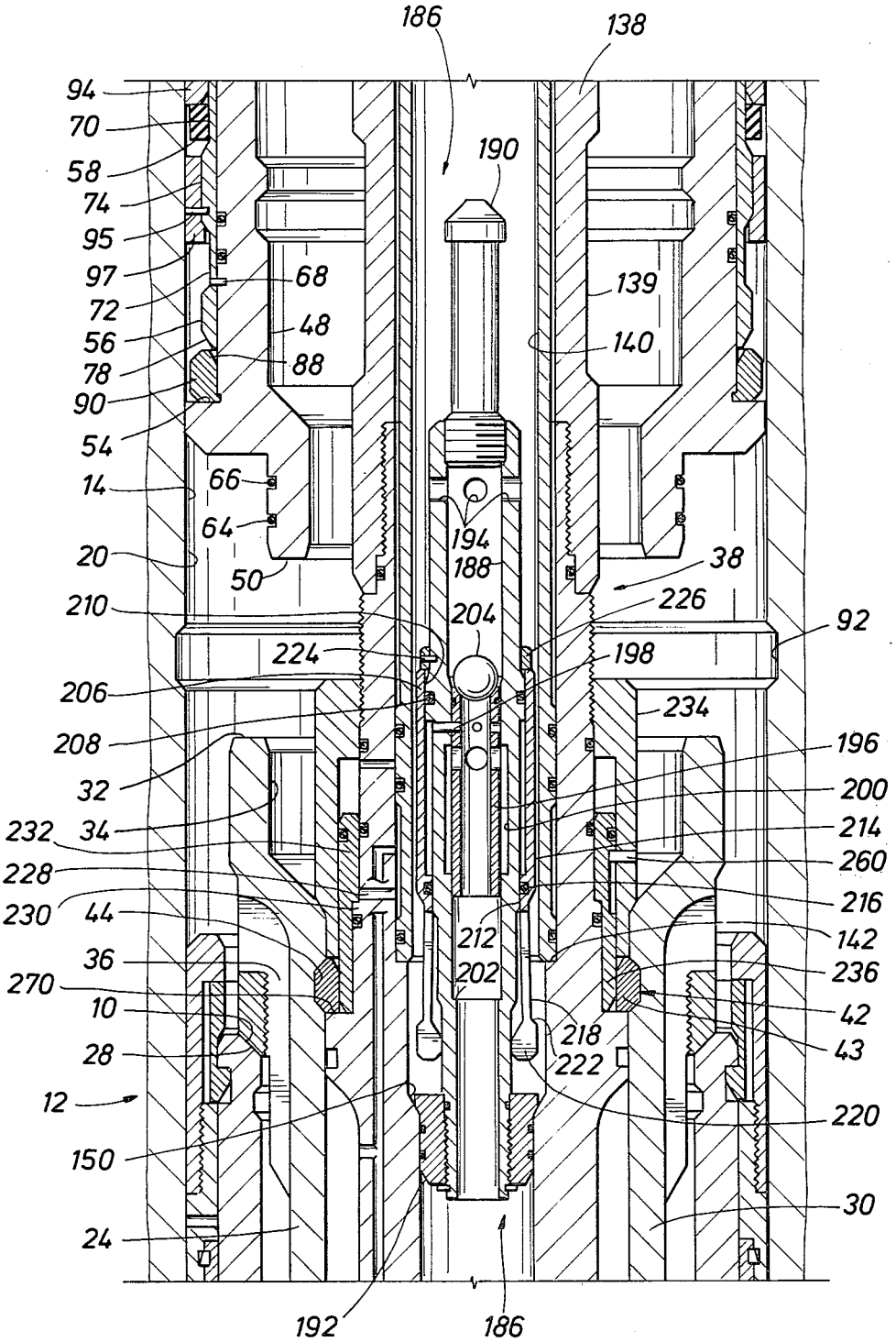
FIG. 7 is a detail sectional view of the position of the running tool and shifting tool as run.
Figure 8:
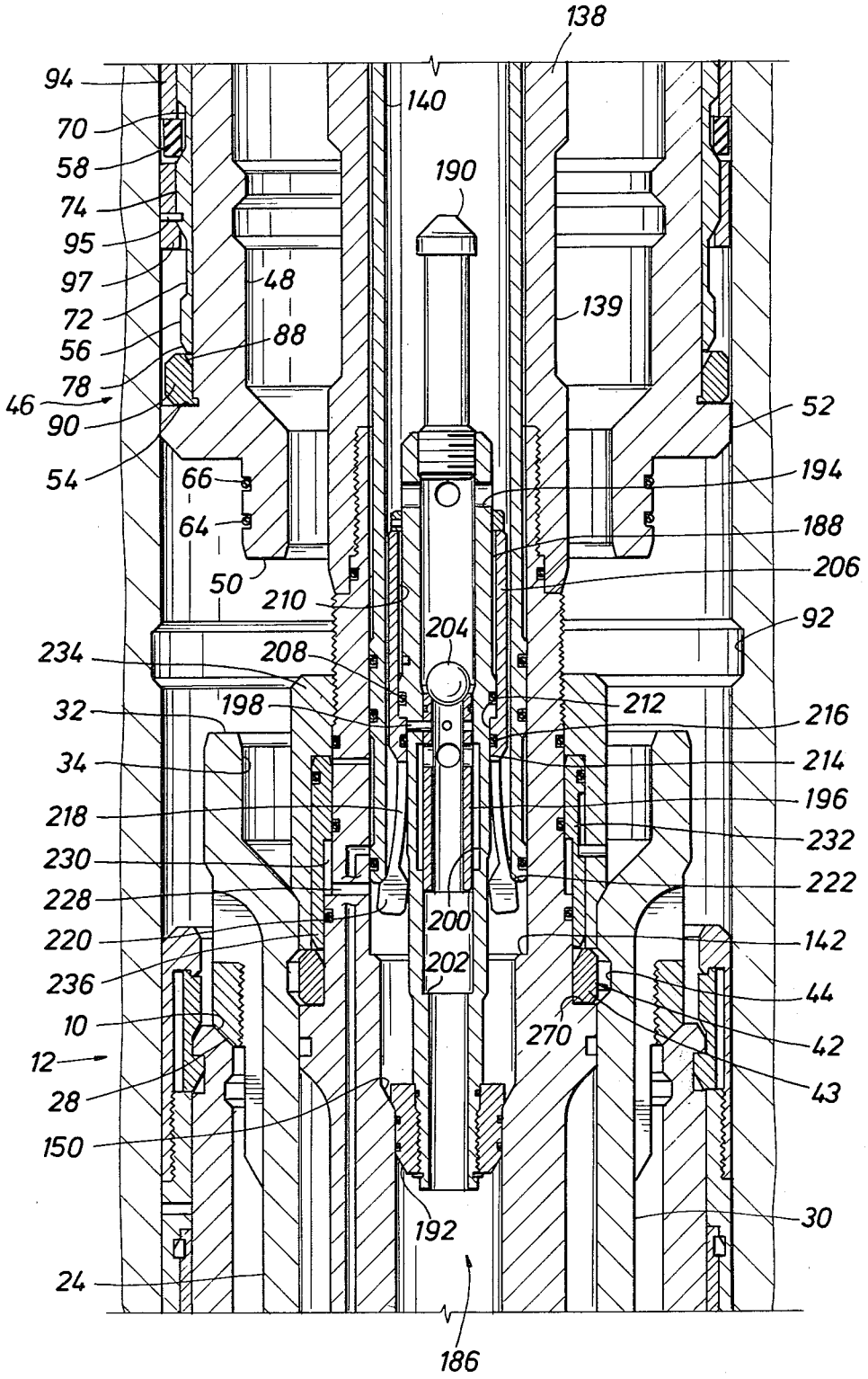
FIG. 8 is another view of the shifting tool with the sleeve shifted as shown in FIG. 3 to release the running tool from the hanger.

When proper seating is assured, dart 184 is recovered and the casing is cemented. Thereafter shifting tool 186 is dropped through string 40 to land on seat 150 as shown in FIGS. 3 and 7. Shifting tool 186, as best seen in FIGS. 7, 8 and 9, includes tubular body 188 with fishing head 190 secured to its upper end for recovery, and landing ring 192 secured to its lower end. Ports 194 provide communication through body 188 immediately below fishing head 190. Sleeve 196 is releasably held in position within body 188 by shear pin 198. In this position, sleeve 196 spans annular recess 200 with its lower end above upwardly facing shoulder 202 and its upper end receiving ball 204 to prevent flow therethrough.

Annular extension 206 surrounds body 188 and O-ring 208 positioned in a groove in body 188 seals against upper interior surface 210 of extension 206. Lower interior surface 212 is also sealed against the smaller diameter exterior surface 214 of body 188 by O-ring 216. Fingers 218 extend downward from extension 206 and have enlarged ends 220 with upwardly facing shoulders 222 which function as hereinafter described.

With shifting tool 186 seated on seat 150, pressure is provided to the interior of string 40. This pressure is carefully controlled not to exceed the pressure at which shear pins 198 release sleeve 196. Pressure in string 40 is maintained by ball 204 seated on the top of sleeve 196 and by ring 192 sealing against the interior of hanger support 138 below seat 150. This pressure is exerted above and below the exterior of body 188 and creates an upwardly directed force on extension 206 due to the different areas of surfaces 210 and 212 exposed to this pressure. This force is sufficient to shear pins 224 which releasably hold collar 226 in position around body 188 to prevent accidental movement of extension 206. As extension 206 moves upward, the interior of ends 220 engage the enlarged diameter of body 188 and this surface holds ends 220 in an outer position so that their further movement causes them to engage the lower end of control sleeve 140 on shoulders 222 shifting sleeve 140 upward to the position shown in FIGS. 4 and 8. In this position, projection 144 on the upper end of control sleeve 140 is moved into upper groove 146 and port 228 through hanger support 138 is uncovered. Port 228 communicates from the interior of support 138 to chamber 230 under annular piston 232. Piston 232 is axially slidable within collar 234 responsive to pressure and in its lower position has its depending skirt 236 positioned behind split latch ring 43, to hold it in locking engagement within groove 44, thus latching hanger 24 to hanger support 138.

The pressure around body 188 is transmitted through port 228 to chamber 230 which causes piston 232 to move upward withdrawing skirt from behind the ring of latch ring 43 and allowing it to withdraw from recess 44 as shown in FIGS. 3 and 8.

With hanger 24 released from hanger support 138, string 40 is raised at least two feet plus the heave of the rig. Pressure in string 40 is increased sufficiently to shear pin 198 and to force sleeve 196 downward in body 188 to the position shown in FIG. 9. This allows circulation to pass through shifting tool 186 to wash out and clean the whole upper portion of hanger, the interior of housing 14 and packer assembly 46. This assures that surface 34 on hanger 24 and surface 64 on packer mandrel 48 are sufficiently clean for sealing.

String 40 is then lowered to the position shown in FIGS. 4, 9 and 12. This moves skirt 50 of mandrel 48 into sealing engagement with surface 34 on hanger rim 32. The lifting of shifting sleeve 140 also brings groove 238 around its exterior into alignment with pins 136. With the downward movement of string 40 and member 122 after seating of mandrel skirt 50, pins 136 are forced inward into groove 238 by the interior surface of member 122 allowing tubular member 122 to move downward with respect to hanger support 138. This brings the inner ends of pins 114 adjacent the reduced diameter portion 139 of support 138 to allow pins 114 to move inward. This movement of pins 114 allows member 122 to move downward with respect to mandrel 48. With this movement, shoulder 120 on collar 121 by its engagement with screw 118 forces actuating sleeve 94 downward. The movement of sleeve 94 shears pins 96 and 95 moving packing ring 58 into sealing position between land 74 and the interior of housing 14 as shown in FIG. 11. Also, this movement brings shoulder 106 into engagement with the upper end of sleeve 56 and groove 86 into registry with groove 110 so that latching ring 84 seats in both grooves 86 and 110 as shown in FIG. 11. The continued downward movement forces sleeve 56 downward behind locking ring 90 to force ring 90 into locked position in groove 92 as shown in FIGS. 4 and 12. Also, upper locking ring 98 moves into engagement with shoulder 99 on the exterior of mandrel 48 but is still held in groove 100.

The seal of packer assembly 46 is tested by closing the rams of the blowout preventer 18 and pressuring the annulus below the rams through the kill line (not shown). If the seal holds, then string 40 is recovered with running tool 38 thereon.

Figure 6:
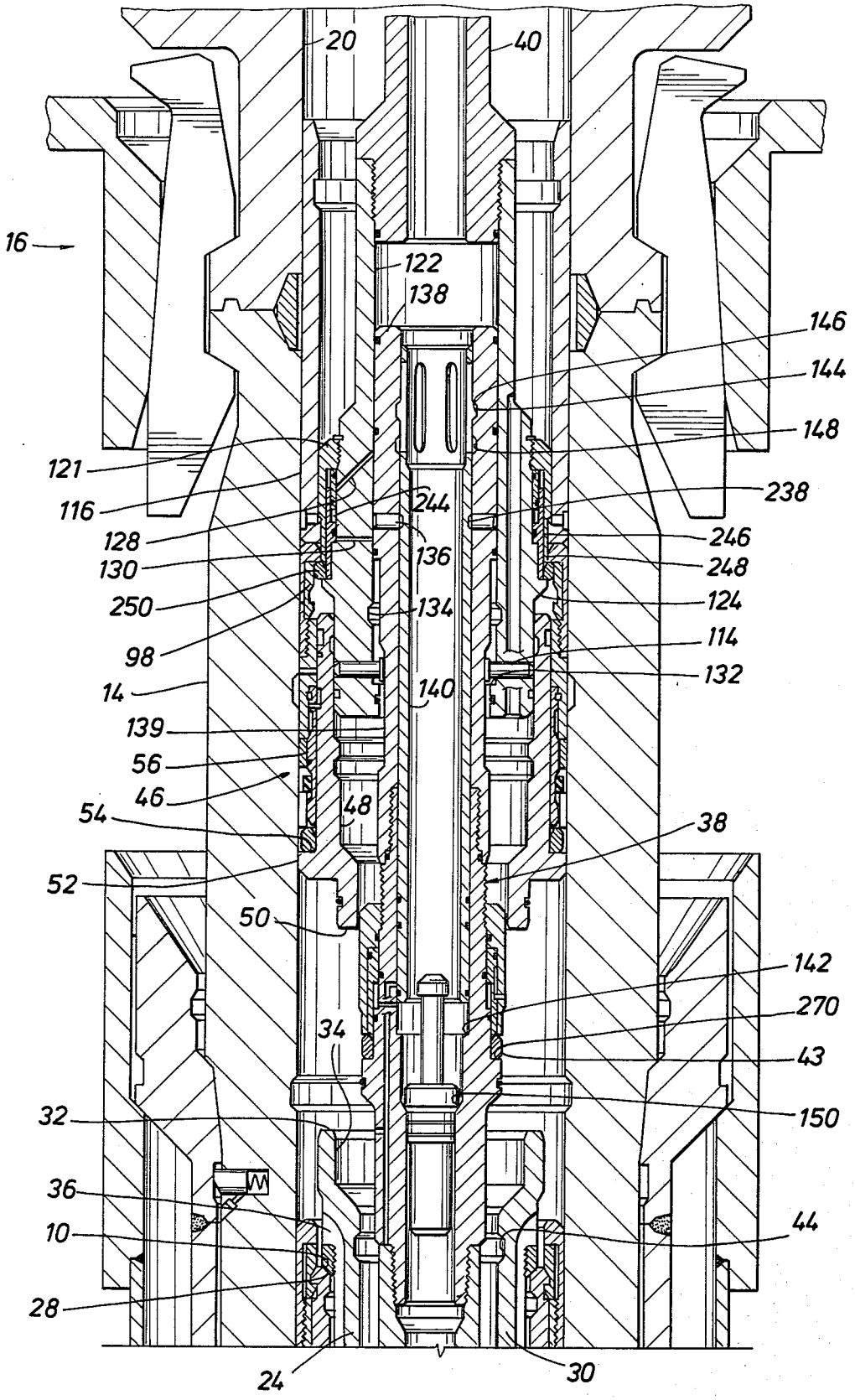
FIG. 6 is another sectional view showing retrieval of the tool and packer assembly.
Figure 13:
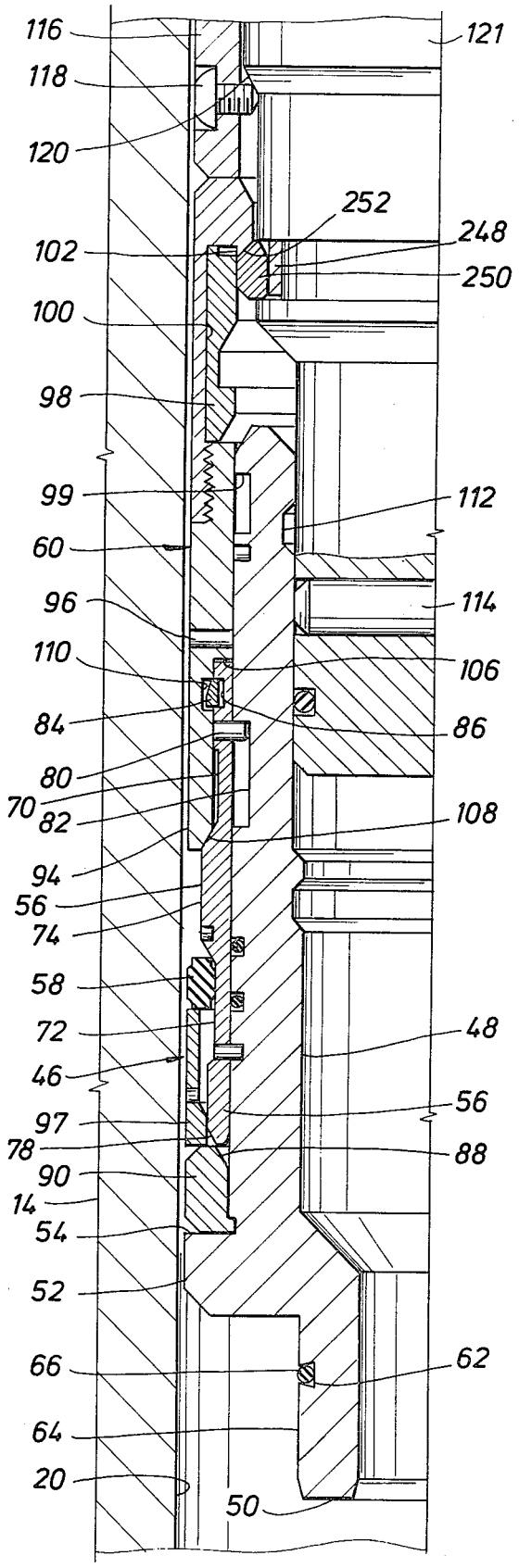
FIG. 13 is another view similar to FIG. 10 but illustrating the retrieval position of the packer assembly.

If the seal does not hold, then packer assembly 46 is recovered and a new assembly run into set position. The recovery of packer assembly 46 is accomplished by retrieving shifting tool 186 and dropping a dart (not shown) to land and seal on seat 150. The position of the components of packer assembly 46 will be as shown in FIGS. 4, 9 and 12. Pressure in string 40 is delivered through port 128 in tubular member 122 into chamber 244. This pressure is exerted on piston 246 to urge it downward. Skirt 248 on the lower end of piston 246 is tapered and wedges split ring 250 outward to engage shoulder 252 on sleeve 94 and to force upper locking ring 98 outward into groove 100 as shown in FIG. 13. Chamber 254 below piston 246 is vented through port 130. Piston 246 slides within collar 121 and ring 258 provides the seals above piston 246 to the interior of collar 121 and the exterior tubular member 122. After piston 246 has been actuated as described above, the lifting of running string 40 raises sleeve 94 through the engagement of ring 250 on shoulder 252 as shown in FIGS. 6 and 13. With upper locking ring 98 moved outward into groove 100 it disengages from shoulder 99 in mandrel 48 so that sleeve 94 and sleeve 56 are moved upward with respect to mandrel 48 because of the connection of ring 84 in grooves 86 and 110. Land 74 is moved out from under packing ring 58 so that packing ring 58 relaxes from sealing engagement and is contained within groove 72 of sleeve 56. When pin 80 reaches the upper end of slot 82 as shown in FIG. 13, then packer assembly 46 and running tool 38 are recovered as shown also in FIG. 6.

A new packer assembly 46 is installed on running tool 38 and moved into set position and tested. The housing protector 116 is retrieved and run with packer assembly 46.

Figure 5:
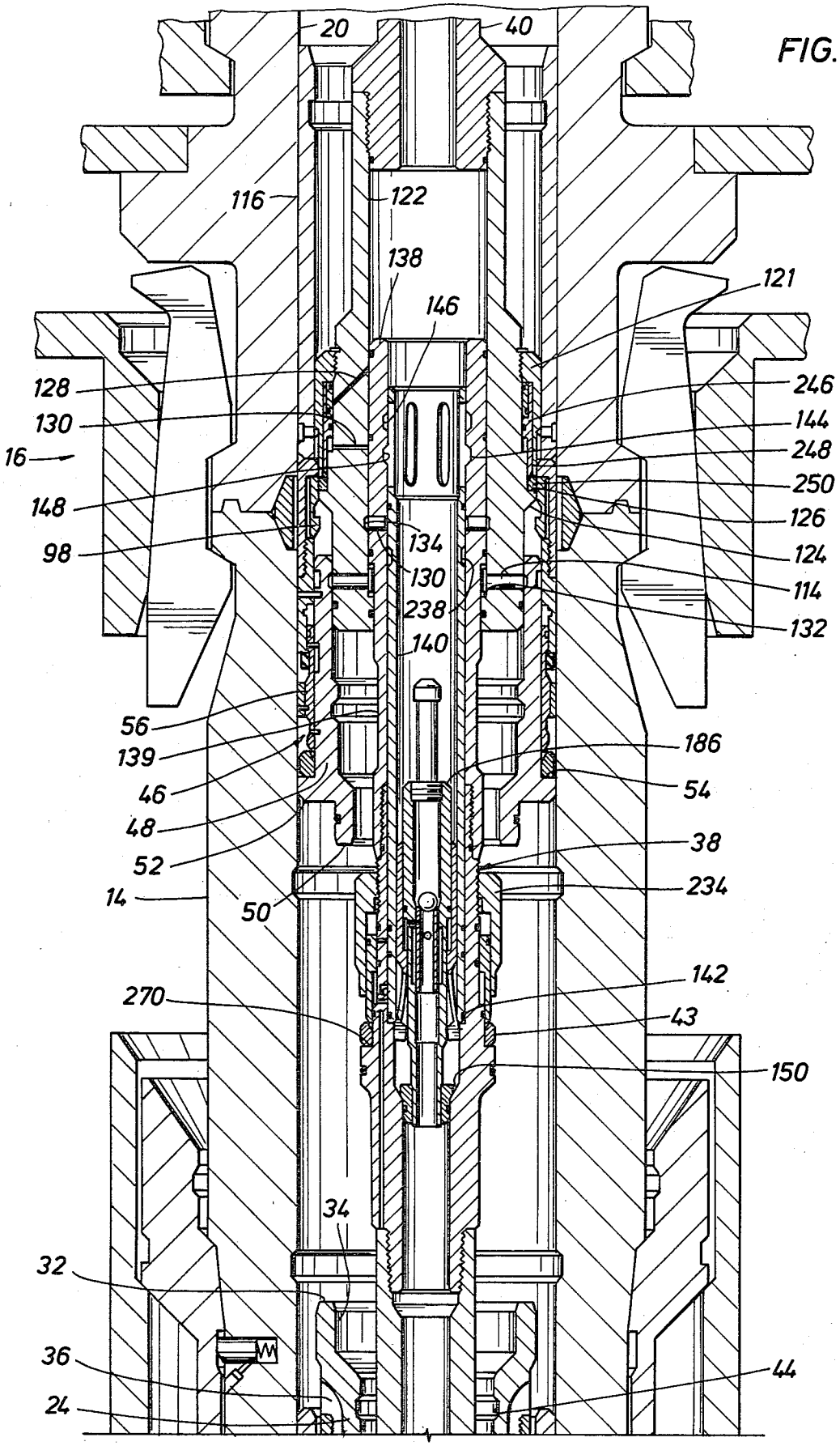
FIG. 5 is another sectional view showing an emergency release of the hanger from the running tool and retrieval of the running tool and packer assembly.

If for any reason casing hanger 24 is not released from running tool 38, emergency release may be effected by rotating running string 40 to the right. This threads hanger support 138 downwardly within collar 234 as shown in FIG. 5. The weight of running string 40 and running tool 38 prevents rotation of collar 234 on hanger 24 during such rotation. As hanger support 138 moves down from the position shown in FIG. 9, pin 260 which is positioned in collar 234 engages the upper end of slot 262 on the exterior of piston 232. This restrains piston 232 from moving downward with hanger support 138. When sufficient rotation is completed to thread collar 234 on support 138, the distance as shown in FIG. 6, then string 40 is raised and before shoulder 270 on support 138 engages the latch ring 43, the interengagement of pin 260 in slot 262 lifts skirt 236 on piston 232 above split latching ring 43 so that it retracts and is picked up by shoulder 270 so that tool 38 and packer assembly 46 are recovered as shown in FIG. 6.

What is claimed is:

1. A well apparatus comprising a hanger body having a downwardly facing external shoulder adapted to land on a well housing landing seat, an external flow passage for the flow of fluids past the landing shoulder and around the exterior of the hanger body and a seal surface above said shoulder, a packer assembly having a mandrel with a lower sealing means adapted to engage and seal against said seal surface on said hanger body, a packing ring, means supporting said packing ring on said mandrel, an actuating sleeve surrounding said mandrel and adapted to move said packing ring into sealing engagement between said mandrel and the interior of the well housing, means for releasably holding said sleeve from movement, and means for securing said mandrel in set position to the interior of said housing, a running tool having means for releasably engaging said hanger body and for releasably engaging said packer assembly whereby, as said tool is run into the well housing and said hanger seats on the housing landing seat, the packer assembly is moved into sealing engagement with said hanger body and with said housing and said tool may be recovered with said hanger body and packer assembly remaining the well housing, said running tool is disengaged from said hanger body prior to the movement to set said packer assembly, said running tool is disengaged from said packer assembly with setting movement of said running tool, and means on said running tool for re-engaging said packer assembly for the recovery of said packer assembly on said running tool in the event said packer assembly does not seal satisfactorily within said well housing.

2. A well apparatus according to claim 1 including a housing protector supported on said running tool and run into the well housing with said hanger body and said packer assembly.

3. A well apparatus according to claim 1 wherein the movement of said running tool for setting said packer assembly is a lowering of said running tool.

4. A well apparatus according to claim 1 including emergency means for disconnecting the engagement between said running tool and said hanger body responsive to rotation of said running tool.

5. A casing hanger apparatus comprising a hanger body having a downwardly facing external shoulder adapted to land on a well housing landing seat, an external flow passage for the flow of fluids past the landing shoulder and around the exterior of the hanger body and an internal seal surface, a packer assembly having a mandrel with a lower skirt which has an external sealing means for sealing against the hanger body internal seal surface and with an upwardly facing external shoulder, a split locking ring supported on said external mandrel shoulder, a locking sleeve releasably secured to the exterior of the mandrel above the locking ring and adapted when moved downward to move the locking ring outward and having an external sealing surface with an upper external groove and a split ring compressed therein, a packing ring surrounding said locking sleeve above said sealing surface, an actuating sleeve surrounding the upper portions of said mandrel and said locking sleeve and having an internal downwardly facing shoulder, an internal groove spaced below said shoulder, an upper internal groove and means releasably connecting said actuating sleeve to said mandrel, and a running tool having means for releasably engaging said hanger body and means for releasably engaging to said packer assembly, said packer assembly engaging means maintaining its engagement after release of said hanger body engaging means so that the packer assembly is lowered to bring its skirt into sealing engagement with the hanger body internal sealing surface and further downward movement of the running tool moves the actuating sleeve downward to move the packing ring into the external sealing surface of the locking sleeve, further movement of the actuating sleeve engaging the locking sleeve on its shoulder to move the locking sleeve downward wedging the split locking ring outward into a groove in the well housing and bring the internal groove in said actuating ring into register with the external groove in the locking sleeve so that the split ring is within both grooves to prevent further relative longitudinal movement between said sleeves.

6. The method of running, landing and setting a casing hanger and packer assembly in a well housing bore having a landing seat including the steps of releasably securing the casing hanger and the packer assembly on the running tool, lowering the running tool on a running string with the casing hanger and packer assembly thereon into the well housing bore to seat the casing hanger on the landing seat, cementing the casing hanger in landed position, releasing the casing hanger from the running tool, picking up the running string and circulate to wash out and clean the upper portion of the casing hanger, the packer assembly and the interior of the well housing, lowering the running string to set the packer assembly and release the running tool from the packer assembly, closing the blowout preventer rams and supply pressure fluid to the annulus above the packer assembly to test the effectiveness of the seal of the packer assembly, recovering the running tool if the packer assembly seal is satisfactory, and reconnecting the well tool to the packer assembly if the packer assembly seal is unsatisfactory.

7. The method according to claim 6 including the step of pressuring the running string to provide an indication of the seating of the casing hanger on the landing seat.

8. The method of running, landing and setting a casing hanger and packer assembly in a well housing having a landing seat including the steps of releasably securing the casing hanger and the packer assembly on the running tool which has a position locator mounted thereon, lowering the running tool on a running string with the casing hanger and packer assembly thereon into the well housing bore to seat the casing hanger on the landing seat, pressuring the running string to indicate the seating of the casing hanger on the landing seat, cementing the casing hanger in landed position, releasing the connection to the casing hanger, lowering the running string to set the packer assembly and release the running tool from the packer assembly, and recovering the running tool.

9. The method of running, landing and testing to determine landing of a hanger on the landing seat with the casing hanger supported on a running tool having a piston positioned on the running tool a preselected distance above the casing hanger and being movable radially outward responsive to fluid pressure within the running string with fluid pressure leaking past said piston when in extended position within the bore of the housing but such leaking being prevented when said piston extends outward beyond the limits of the housing bore including the steps of releasably securing the casing hanger on the running tool, positioning the piston on the running tool a preselected distance above the casing hanger which is substantially the same distance as the distance from the housing landing seat on which the casing hanger is to be landed to the guideways in the blowout preventer above the landing seat, lowering the running tool within the well bore to land the casing hanger on the landing seat, supplying pressure to the interior of the running tool to a preselected level, closing the supply of fluid pressure to the running tool, and indicating the pressure in the running tool as an indication of the seating of the hanger if such pressure does not drop appreciably.

10. A well apparatus comprising a hanger body having a downwardly facing external shoulder adapted to land on a well housing landing seat, an external flow passage for the flow of fluids past the landing shoulder and around the exterior of the hanger body and a seal surface above said shoulder, a packer assembly having a mandrel with a lower sealing means adapted to engage and seal against said seal surface on said hanger body, a packing ring, means supporting said packing ring on said mandrel, an actuating sleeve surrounding said mandrel and adapted to move said packing ring into sealing engagement between said mandrel and the interior of the well housing, means for releasably holding said sleeve from movement, and means for securing said mandrel in set position to the interior of said housing, a running tool having means for releasably engaging said hanger body and for releasably engaging said packer assembly whereby, as said tool is run into the well housing and said hanger seats on the housing landing seat, the packer assembly is moved into sealing engagement with said hanger body and with said housing and said tool may be recovered with said hanger body and packer assembly remaining the well housing, and a position locator positioned on said running tool to provide an indication of the landing of the casing hanger on the well housing landing seat.

11. A well apparatus comprising a hanger body having a downwardly facing external shoulder adapted to land on a well housing landing seat, an external flow passage for the flow of fluids past the landing shoulder and around the exterior of the hanger body and a seal surface above said shoulder, a packer assembly having a mandrel with a lower sealing means adapted to engage and seal against said seal surface on said hanger body, a packing ring, means supporting said packing ring on said mandrel, an actuating sleeve surrounding said mandrel and adapted to move said packing ring into sealing engagement between said mandrel and the interior of the well housing, means for releasably holding said sleeve from movement, and means for securing said mandrel in set position to the interior of said housing, a running tool having means for releasably engaging said hanger body and for releasably engaging said packer assembly whereby, as said tool is run into the well housing and said hanger seats on the housing landing seat, the packer assembly is moved into sealing engagement with said hanger body and with said housing and said tool may be recovered with said hanger body and packer assembly remaining the well housing, and a shifting tool adapted to be dropped through the bore of said running tool and being responsive to fluid pressure therein to uncover a port through the running tool to provide fluid under pressure to the means for releasably engaging said hanger body to cause the release of such engagement.

12. A well apparatus according to claim 11, wherein said shifting tool includes means for closing flow through said running tool during the release of the hanger body engaging means, said closing means being responsive to fluid pressure in said running tool higher than pressure for release of said hanger body engaging means to open flow therethrough.

13. A well apparatus comprising a hanger body having a downwardly facing external shoulder adapted to land on a well housing landing seat, an external flow passage for the flow of fluids past the landing shoulder and around the exterior of the hanger body and a seal surface above said shoulder, a packer assembly having a mandrel with a lower sealing means adapted to engage and seal against said seal surface on said hanger body, a packing ring, means supporting said packing ring on said mandrel, an actuating sleeve surrounding said mandrel and adapted to move said packing ring into sealing engagement between said mandrel and the interior of the well housing, means for releasably holding said sleeve from movement, and means for securing said mandrel in set position to the interior of said housing, a running tool having means for releasably engaging said hanger body and for releasably engaging said packer assembly whereby, as said tool is run into the well housing and said hanger seats on the housing landing seat, the packer assembly is moved into sealing engagement with said hanger body and with said housing and said tool may be recovered with said hanger body and packer assembly remaining the well housing, and means on said packer assembly for protecting said packing ring from engagement during the running of said hanger body and said packer assembly into said well housing.

14. A well apparatus comprising a hanger body having a downwardly facing external shoulder adapted to land on a well housing landing seat, an external flow passage for the flow of fluids past the landing shoulder and around the exterior of the hanger body and a seal surface above said shoulder, a packer assembly having a mandrel with a lower sealing means adapted to engage and seal against said seal surface on said hanger body, a packing ring, means supporting said packing ring on said mandrel, an actuating sleeve surrounding said mandrel and adapted to move said packing ring into sealing engagement between said mandrel and the interior of the well housing, means for releasably holding said sleeve from movement, and means for securing said mandrel in set position to the interior of said housing, a running tool having means for releasably engaging said hanger body and for releasably engaging said packer assembly whereby, as said tool is run into the well housing and said hanger seats on the housing landing seat, the packer assembly is moved into sealing engagement with said hanger body and with said housing and said tool may be recovered with said hanger body and packer assembly remaining the well housing, and a sleeve surrounding a portion of said mandrel having an upper groove, a lower groove, an upper land between said grooves, a lower land below said lower groove, and a downwardly and inwardly tapered surface on the lower exterior of said lower land, said packing ring being positioned in said upper groove during running and being moved by said actuating sleeve into position on said upper land to seal between said upper land and the interior of the well housing.

15. A well apparatus according to claim 14 wherein said mandrel securing means includes a split locking ring surrounding said mandrel and adapted to be moved into engagement partially within a groove on the interior of said well housing, said lower tapered surface on said sleeve coacting with said split locking ring to move it into said groove to secure said mandrel in set position.

* * * * *